US011175045B2

(12) United States Patent
Benjamin et al.

(10) Patent No.: US 11,175,045 B2
(45) Date of Patent: Nov. 16, 2021

(54) FUEL NOZZLE FOR GAS TURBINE ENGINE COMBUSTOR

(71) Applicant: General Electric Company, Schenectady, NY (US)

(72) Inventors: Michael Anthony Benjamin, Cincinnati, OH (US); Girish Venkata Satya Sesha Goda, Bangalore (IN); Habeeb Kunnummal Manat, Bangalore (IN); Karthikeyan Sampath, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 405 days.

(21) Appl. No.: 15/861,791

(22) Filed: Jan. 4, 2018

(65) Prior Publication Data

US 2019/0203929 A1 Jul. 4, 2019

(51) Int. Cl.
*F23R 3/28* (2006.01)
*F23R 3/10* (2006.01)
(Continued)

(52) U.S. Cl.
CPC ..... *F23R 3/286* (2013.01); *F23R 3/10* (2013.01); *F23R 3/18* (2013.01); *F23R 3/28* (2013.01); *F23C 7/004* (2013.01); *F23C 7/008* (2013.01); *F23R 3/14* (2013.01); *F23R 3/343* (2013.01); *F23R 2900/00013* (2013.01)

(58) Field of Classification Search
CPC .. F23R 3/286; F23R 3/343; F23R 3/12; F23R 3/14; F23R 3/18; F23R 3/20; F23R 2900/03282; F23R 2900/00014; F05D 2260/96; F05D 2260/964; F05D 2270/14; F23D 11/101; F23D 11/102;
(Continued)

(56) References Cited

U.S. PATENT DOCUMENTS 2,607,193 A 8/1952 Berggren et al.
2,958,195 A 11/1960 Dooley
(Continued)

FOREIGN PATENT DOCUMENTS

CN 102589009 A 7/2012

OTHER PUBLICATIONS

Chinese Office Action Corresponding to Application No. 20191006920 dated Mar. 18, 2020.

*Primary Examiner* — Craig Kim
*Assistant Examiner* — Stephanie Sebasco Cheng
(74) *Attorney, Agent, or Firm* — Venable LLP; Edward A. Kmett; Michele V. Frank

(57) ABSTRACT

A method and structure for operating a combustion system of a gas turbine engine to mitigate low frequency combustion acoustics is generally provided. The method includes flowing an oxidizer through a fuel nozzle passage defining an inner wall and an outer wall, in which each of the inner wall and the outer wall are contoured from a first radius to a second radius smaller than the first radius; flowing the oxidizer at a higher axial velocity at the inner wall relative to the outer wall upstream of a fuel injection port; flowing a fuel through the fuel injection port to the fuel nozzle passage to mix with the flow of oxidizer to produce a fuel-oxidizer mixture; and igniting the fuel-oxidizer mixture downstream of the fuel injection port.

14 Claims, 7 Drawing Sheets

(51) Int. Cl.

| | |
|---|---|
| ***F23R 3/18*** | (2006.01) |
| ***F23R 3/14*** | (2006.01) |
| *F23C 7/00* | (2006.01) |
| *F23R 3/34* | (2006.01) |

(58) Field of Classification Search
CPC .... F23D 11/103; F23D 11/104; F23D 11/105; F23D 11/12; F23D 11/383
See application file for complete search history.

(56) References Cited

U.S. PATENT DOCUMENTS

| | | | | |
|---|---|---|---|---|
| 4,070,826 | A | 1/1978 | Stenger et al. | |
| 6,968,692 | B2 * | 11/2005 | Chin | F23R 3/14 431/182 |
| 7,506,510 | B2 * | 3/2009 | Thomson | F23R 3/283 60/740 |
| 7,614,211 | B2 | 11/2009 | Chapin et al. | |
| 7,621,132 | B2 * | 11/2009 | Cornwell | F23R 3/286 60/747 |
| 8,375,721 | B2 * | 2/2013 | Wilbraham | F23R 3/14 60/748 |
| 8,607,571 | B2 * | 12/2013 | Williams | F23R 3/286 60/743 |
| 8,789,373 | B2 | 7/2014 | Huth | |
| 9,279,587 | B2 | 3/2016 | Clemen et al. | |
| 9,518,740 | B2 * | 12/2016 | Biagioli | F23R 3/14 |
| 9,625,156 | B2 | 4/2017 | Rudrapatna et al. | |
| 2005/0106520 | A1 * | 5/2005 | Cornwell | F23D 14/74 431/116 |
| 2009/0111063 | A1 * | 4/2009 | Boardman | F23R 3/36 431/8 |
| 2009/0255265 | A1 * | 10/2009 | McMasters | B23P 6/007 60/748 |
| 2010/0300102 | A1 * | 12/2010 | Bathina | F23R 3/286 60/737 |
| 2012/0181355 | A1 | 7/2012 | Corry et al. | |
| 2012/0304649 | A1 * | 12/2012 | Matsuyama | F23R 3/286 60/737 |
| 2014/0096502 | A1 * | 4/2014 | Karlsson | F23K 5/12 60/39.59 |
| 2016/0258627 | A1 | 9/2016 | Cheung et al. | |
| 2017/0284673 | A1 | 10/2017 | Williams | |

* cited by examiner

FUEL NOZZLE FOR GAS TURBINE ENGINE COMBUSTOR

FIELD

The present subject matter is directed to methods and structures for mitigating combustion acoustics in gas turbine engines.

BACKGROUND

Gas turbine engines include combustion systems in which a fuel is supplied and mixed with air and ignited to produce combustion gases. However, known lean-burn and rich-burn combustion systems may suffer from undesired combustion dynamics at various conditions, such as at sub-idle, idle, and generally lower power conditions. Such adverse combustion dynamics include high pressure oscillations that may damage the combustion system and the gas turbine engine, or generate audible acoustics that may damage the gas turbine engine or create discomfort or hearing difficulty for surrounding people (e.g., at an airport or in an aircraft).

As such, there is a need for a combustion system and methods of operation that reduce or eliminate adverse combustion dynamics. More specifically, there is a need for a combustion system that reduces or eliminates adverse combustion dynamics corresponding to low frequency acoustics or growl at sub-idle, idle, and generally low power operating conditions.

BRIEF DESCRIPTION

Aspects and advantages of the invention will be set forth in part in the following description, or may be obvious from the description, or may be learned through practice of the invention.

A method and structure for operating a combustion system of a gas turbine engine to mitigate low frequency combustion acoustics is generally provided. The method includes flowing an oxidizer through a fuel nozzle passage defining an inner wall and an outer wall, in which each of the inner wall and the outer wall are contoured from a first radius to a second radius smaller than the first radius; flowing the oxidizer at a higher axial velocity at the inner wall relative to the outer wall upstream of a fuel injection port; flowing a fuel through the fuel injection port to the fuel nozzle passage to mix with the flow of oxidizer to produce a fuel-oxidizer mixture; and igniting the fuel-oxidizer mixture downstream of the fuel injection port.

The present disclosure is further directed to a combustion system for a gas turbine engine. The combustion system includes a fuel nozzle comprising an inner wall and an outer wall together defining a fuel nozzle passage through which an oxidizer flows toward a combustion chamber. The inner wall and the outer wall together define a contoured portion from a first radius to a second radius smaller than the first radius. The inner wall defines a fuel injection port therethrough in fluid communication with the fuel nozzle passage. The outer wall defines a throat at the fuel nozzle passage and an exit plane at a downstream end of the outer wall adjacent to the combustion chamber. The fuel nozzle defines a forward stagnation point of the flow of oxidizer between the throat and the exit plane.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
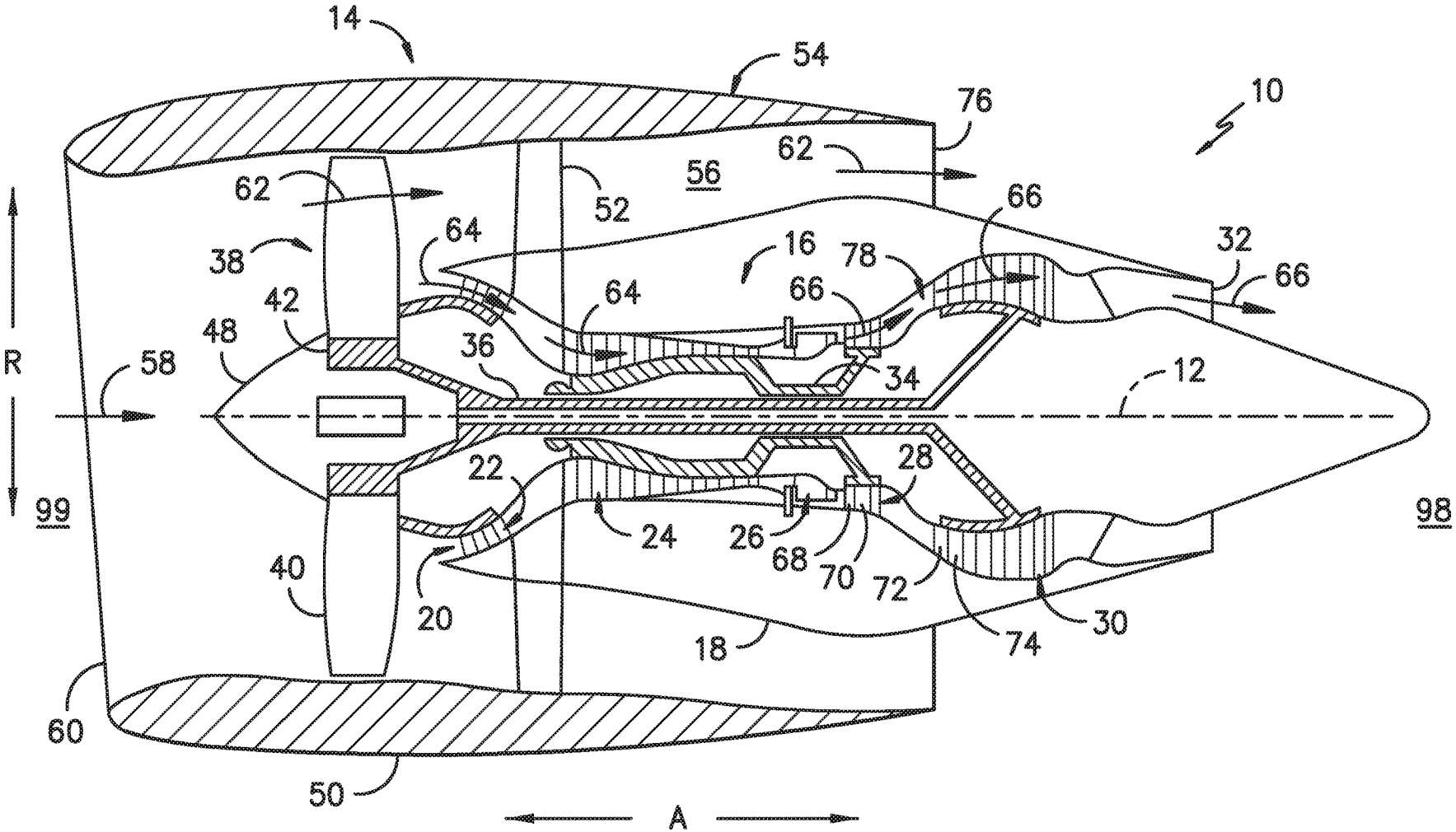
FIG. 1 is an axial cross sectional view of an exemplary embodiment of a gas turbine engine including an exemplary combustion system according to an aspect of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Approximations recited herein may include margins based on one more measurement devices as used in the art, such as, but not limited to, a percentage of a full scale measurement range of a measurement device or sensor. Alternatively, approximations recited herein may include margins of 10% of an upper limit value greater than the upper limit value or 10% of a lower limit value less than the lower limit value.

Embodiments of a combustion system and methods of operation that reduce or eliminate adverse combustion dynamics are generally provided. The embodiments of the combustion system and methods of operation generally provided herein may reduce or eliminate adverse combustion dynamics corresponding to low frequency acoustics or growl at sub-idle, idle, and generally low power operating conditions. The structures and methods generally provided herein control a velocity profile of a flow of oxidizer through a fuel nozzle passage such as to reduce or eliminate low frequency acoustics. The structures and methods generally provided may generally dispose a forward stagnation point of a pilot fuel-oxidizer combustion zone between a throat and an exit plane of a pilot fuel nozzle. Still further, the structures and methods generally provided herein may further increase the flow of oxidizer through the fuel nozzle passage, or more specifically, selectively increase the flow of oxidizer relative to the inner wall in contrast to the outer wall of the fuel nozzle.

Referring now to the drawings, wherein identical numerals indicate the same elements throughout the figures, FIG. 1 is a schematic cross-sectional view of a gas turbine engine in accordance with an exemplary embodiment of the present disclosure. More particularly, for the embodiment of FIG. 1, the gas turbine engine is a high-bypass turbofan engine 10, referred to herein as "engine 10." As shown in FIG. 1, the engine 10 defines an axial direction A (extending parallel to a longitudinal centerline 12 provided for reference) and a radial direction R extended from the longitudinal centerline 12. The engine 10 further defines a reference upstream end 99 from which a flow of oxidizer (e.g., air) enters the engine 10, and a downstream end 98 at which the flow of oxidizer exits the engine 10. In general, the engine 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion system 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22. In other embodiments of engine 10, additional spools may be provided such that engine 10 may be described as a multi-spool engine.

For the depicted embodiment, fan section 14 includes a fan 38 having a plurality of fan blades 40 coupled to a disk 42 in a spaced apart manner. As depicted, fan blades 40 extend outward from disk 42 generally along the radial direction R. The fan blades 40 and disk 42 are together rotatable about the longitudinal axis 12 by LP shaft 36. In some embodiments, a power gear box having a plurality of gears may be included for stepping down the rotational speed of the LP shaft 36 to a more efficient rotational fan speed.

Referring still to the exemplary embodiment of FIG. 1, disk 42 is covered by rotatable spinner cap 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. It should be appreciated that nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass airflow passage 56 therebetween.

During operation of the engine 10, a volume of air 58 enters engine 10 through an associated inlet 60 of the nacelle 50 and/or fan section 14. As the volume of air 58 passes across fan blades 40, a first portion of the air 58 as indicated by arrows 62 is directed or routed into the bypass airflow passage 56 and a second portion of the air 58 as indicated by arrows 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion system 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the engine 10, also providing propulsive thrust. The HP turbine 28, the LP turbine 30, and the jet exhaust nozzle section 32 at least partially define a hot gas path 78 for routing the combustion gases 66 through the core turbine engine 16.

It will be appreciated that, although described with respect to engine 10 having core turbine engine 16, the present subject matter may be applicable to other types of turbomachinery. For example, the present subject matter may be suitable for use with or in turboprop, turboshaft, turbojet, industrial and marine gas turbine engines, and/or auxiliary power units.

Figure 2:
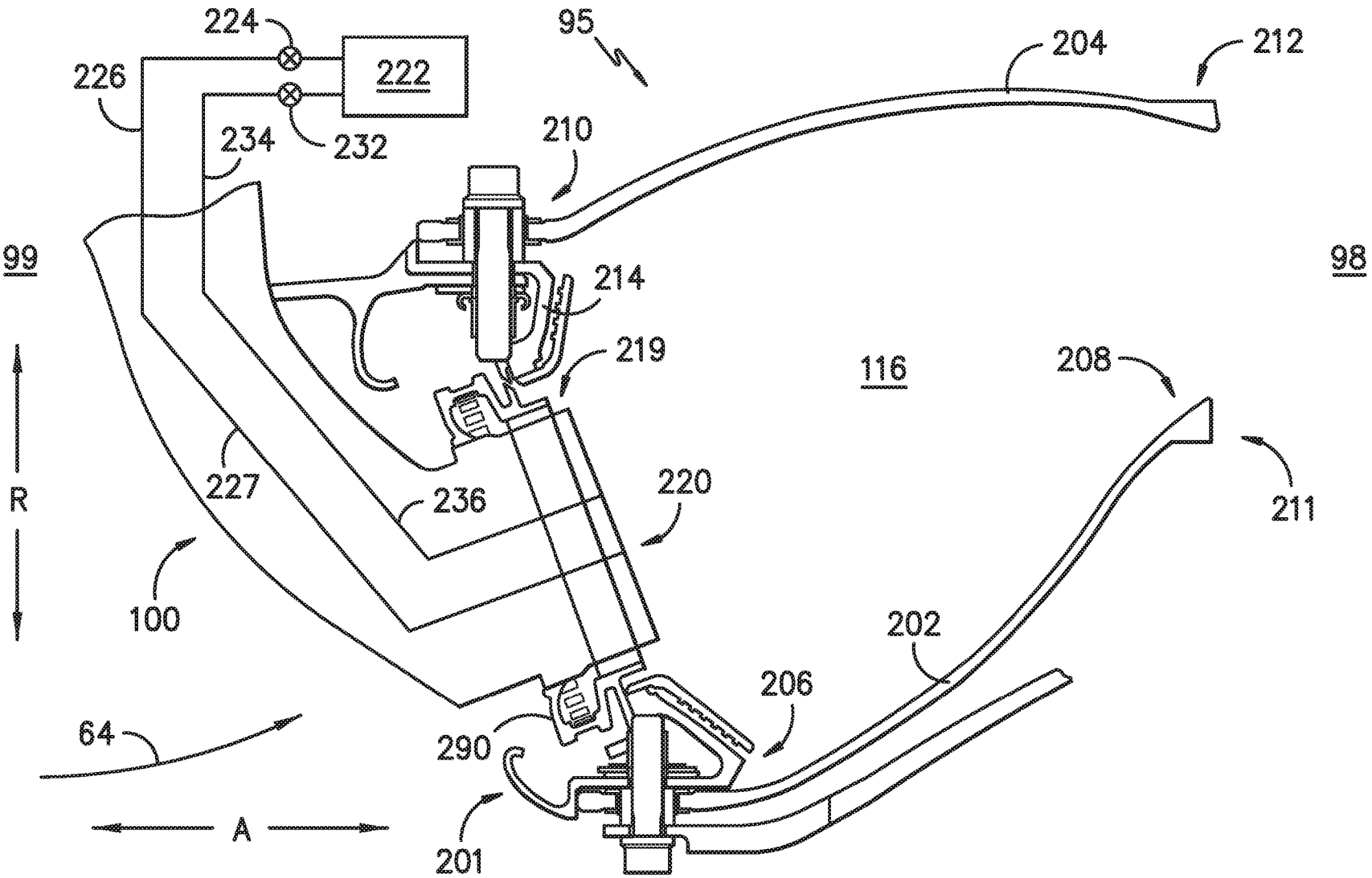
FIG. 2 is an axial cross sectional view of an exemplary combustion system of the gas turbine engine generally provided in FIG. 1 according to an aspect of the present disclosure.

FIG. 2 provides a schematic cross-sectional view of a combustor assembly 95, e.g., for use in the combustion system 26 of the gas turbine engine 10 of FIG. 1, according to an exemplary embodiment of the present subject matter. As shown in FIG. 2, the combustor assembly 95 defines a forward end 201 and an aft end 211. The combustor assembly 95 further includes an annular inner liner 202 and an annular outer liner 204. The inner liner 202 extends generally along the axial direction A between an upstream end 206 and a downstream end 208. Similarly, the outer liner 204 extends generally along the axial direction A between an upstream end 210 and a downstream end 212.

A combustor dome 214 extends generally along the radial direction R between the upstream end 206 of the inner liner 202 and the upstream end 210 of the outer liner 204. As shown in FIG. 2, the inner liner 202, the outer liner 204, and the combustor dome 214 define a combustion chamber 116 therebetween. In some embodiments, the combustor dome 214 is integral with the inner liner 202, i.e., the inner liner 202 and the combustor dome 214 are integrally formed as a single piece structure, but in other embodiments, the combustor dome 214 is integral with the outer liner 204, i.e. the outer liner 204 and the combustor dome 214 are integrally formed as a single piece structure. In still other embodiments, the combustor dome 214 is formed separately from the inner liner 202 and the outer liner 204, or in yet other embodiments, the combustor dome 214 is integral with both the inner and outer liners 202, 204, e.g., at least a first portion of the combustor dome 214 may be integral with the inner liner 202 and at least a second portion of the combustor dome 214 may be integral with the outer liner 204. The combustor dome 214 may be formed from any suitable material, e.g., a CMC material or a metallic material, such as a metal or metal alloy.

Further, the combustor assembly 95 includes a fuel nozzle 100 defining a fuel nozzle outlet 220 at an outlet end 219 of the fuel nozzle 100. A main mixer or swirler assembly 290 extends about the fuel nozzle outlet 220 as described in greater detail below. The fuel nozzle 100 is disposed through the combustor dome 214 such that the fuel nozzle outlet 220 is disposed at or adjacent the forward end 201 of the combustor assembly 95 to direct a fuel-oxidizer mixture into the combustion chamber 116. More particularly, the exemplary fuel nozzle 100 is of a type configured to inject liquid hydrocarbon fuel into an airflow stream of the combustor assembly 95. The fuel nozzle 100 is of a "staged" type, meaning it is operable to selectively inject fuel through two or more discrete stages, each stage being defined by individual fuel flowpaths within the fuel nozzle 100. For example, the fuel nozzle 100 may define one or more of the pilot fuel circuit 228, 230 and one or more of the main fuel circuit 236.

The fuel flow rate may be variable within each of the stages. In the exemplary embodiment depicted in FIG. 2, the fuel nozzle 100 is connected to a fuel system 222 that is operable to supply a flow of liquid fuel at varying flow rates according to operational need. The fuel system 222 supplies fuel to a pilot control valve 224 that is coupled to a pilot fuel conduit 226, which in turn supplies fuel to a pilot supply line 227. In various embodiments, such as shown in regard to FIG. 3, the pilot supply line 227 may further subdivide into a first pilot supply line 228 and a second pilot supply line 230 within the fuel nozzle 100. The first pilot supply line 228 provides a flow of fuel or fuel-oxidizer mixture to the combustion chamber 116 via a fuel injection port 127, as further described in regard to FIG. 3. The second pilot supply line 230 provides a flow of fuel or fuel-oxidizer mixture to the combustion chamber 116 via a second fuel injection port 129, such as further described in regard to FIG. 3. Within one or more of the first pilot supply line 228 or the second pilot supply line 230 may be disposed a fuel atomizer. In various embodiments, the fuel atomizer may define a pressure swirl atomizer, a dual orifice atomizer, plain or air-assisted jets, or other suitable method(s) of fuel injection.

In still other embodiments, the pilot supply line 227 may further subdivide into a third or more pilot supply line. The fuel system 222 also supplies fuel to a main valve 232 that is coupled to a main fuel conduit 234, which in turn supplies a main fuel circuit of the fuel nozzle 100. In various embodiments, the main fuel circuit may further subdivide into two or more main fuel circuit lines egressing fuel into the combustion chamber 116.

Figure 3:
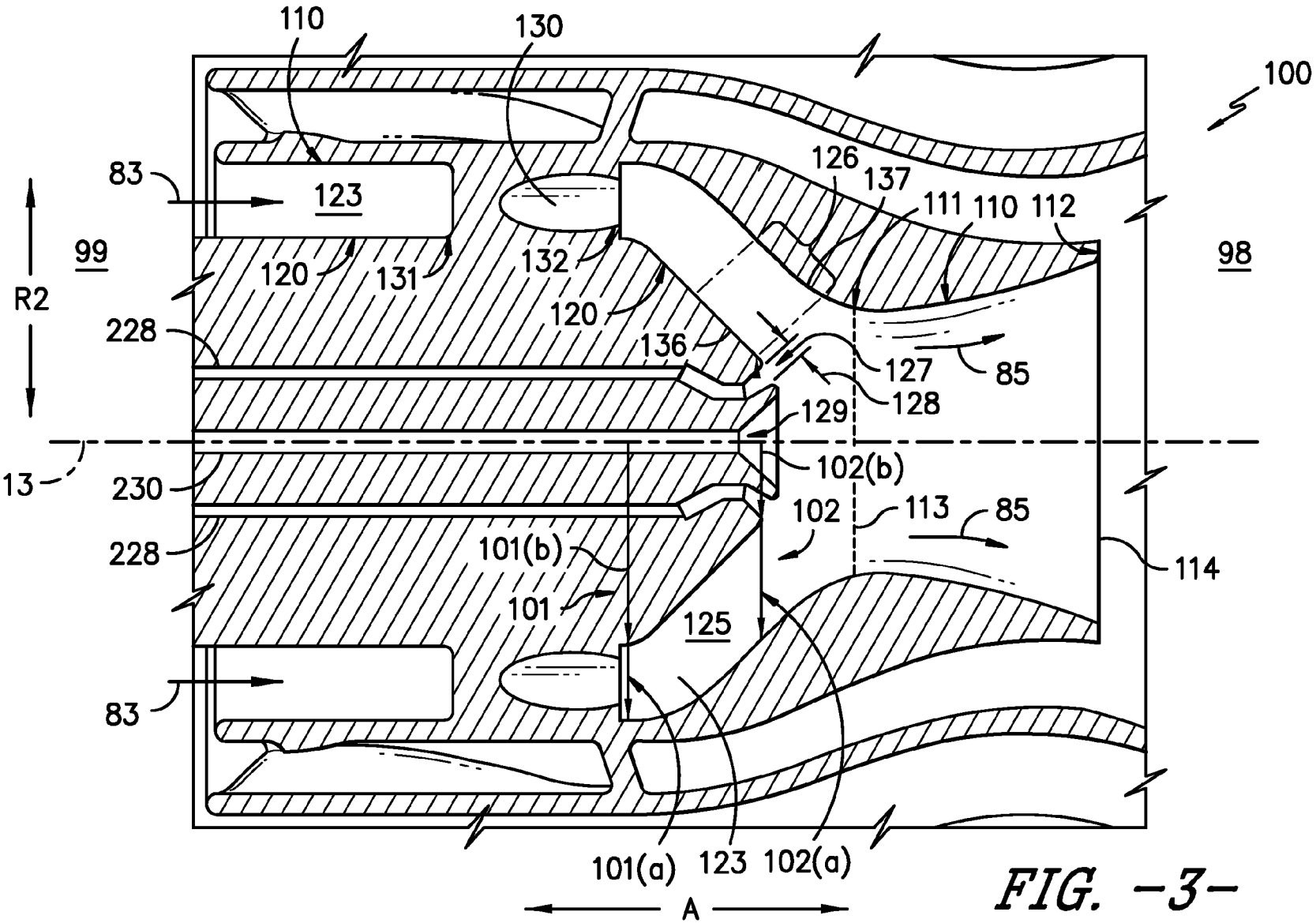
FIG. 3 is an axial cross sectional view of an exemplary embodiment of a fuel nozzle of the combustion system generally provided in FIG. 2.

Referring now to FIG. 3, a cross sectional view of a portion of the fuel nozzle 100 is generally provided. The fuel nozzle 100 generally defines at least a dual stage fuel nozzle. For example, the fuel nozzle 100 includes at least one pilot fuel circuit and at least one main fuel circuit. Generally, the pilot fuel circuit egresses fuel or a fuel-oxidizer mixture into the combustion chamber 116 such as to enable or promote ignition and low power operation (e.g., sub-idle condition, idle condition, mid-power or part-load operation, etc.). The pilot fuel circuit may further tune or otherwise influence combustion emissions, pattern factor, and dynamics. Combustion dynamics, such as low frequency acoustics or low "growl", may result in undesired vibrations and acoustic noise that may damage the fuel nozzle 100, combustor assembly 95, and the engine 10. Furthermore, acoustic noise may result in human discomfort, up to and including hearing damage or hearing loss if sustained over a sufficient period of time.

The main fuel circuit may generally provide fuel or a fuel-oxidizer mixture to the combustion chamber 116 at one or more mid-power or high-power or full-load conditions, such as to provide up to a maximum overall fuel-air ratio to the combustion chamber 116.

The fuel nozzle 100 includes an inner wall 120 and an outer wall 110 together defining a fuel nozzle passage 123. In various embodiments, approximately 50% or less of a total flow of oxidizer 64 from the compressors 22, 24 enters the plurality of fuel nozzles 100 of the combustion system 26. A flow of oxidizer 83 egresses through the fuel nozzle passage 123 from an upstream end 99 toward the combustion chamber 116. The flow of oxidizer 83 depicted in FIG. 3 is generally at least a portion of the flow of oxidizer 64 (e.g., compressed air) from the compressors 22, 24 into the combustion system 26. In various embodiments, the flow of oxidizer 83 through the fuel nozzle 100 to supply oxidizer to mix with fuel from one or more of the pilot supply line 227 (FIG. 2) is approximately 25% or less of a total flow of oxidizer 64 from the compressors 22, 24 entering the combustion system 26.

The inner wall 120 and the outer wall 110 together define a contoured portion 125 of the fuel nozzle passage 123 from a first radius 101 to a second radius 102 smaller than the first radius 101. For example, the first radius 101 may generally define an outer first radius 101(*a*) relative to the outer wall 110 and an inner first radius 101(*b*) relative to the inner wall 120. The second radius 102 may generally define an outer second radius 102(*a*) relative to the outer wall 110 and an inner second radius 102(*b*) relative to the inner wall 120. Each radii 101, 102 are defined relative to a nozzle centerline 13 extended through each fuel nozzle 100 and along a radial direction R2 extended from the nozzle centerline 13.

The inner wall 120 is defined generally cylindrical around the nozzle centerline 13 and extended along the axial direction A, such as to define a centerbody through which a fuel or fuel-oxidizer mixture flows. The inner wall 120 defines a fuel injection port 127 therethrough in fluid communication with the fuel nozzle passage 123. The fuel injection port 127 may be defined as a plurality of discrete openings through the inner wall 120 arranged circumferentially around the nozzle centerline 13. The fuel injection port 127 further defines a major axis dimension or diameter 128 through the inner wall 120. As such, it should be understood that the fuel injection port 127 may define a circular cross sectional area through the inner wall 120 or an elliptical, ovular, or oblong cross sectional area, such as to define a major axis and a minor axis smaller than the major axis. As further described herein, the major axis dimension or diameter 128 of the fuel injection port 127 may provide a reference basis for defining a length or distance from the fuel injection port 127 along the fuel nozzle passage 123.

The fuel nozzle 100 further defines a second fuel injection port 129 disposed generally concentric to the nozzle centerline 13. In various embodiments, a dual orifice atomizer or a pressure swirl atomizer is defined along the pilot fuel circuit in fluid communication with one or both of the fuel injection port 127 and the second fuel injection port 129. The second fuel injection port 129 may generally provide a generally conical spray of fuel or fuel-oxidizer mixture into the combustion chamber 116.

Figure 6:
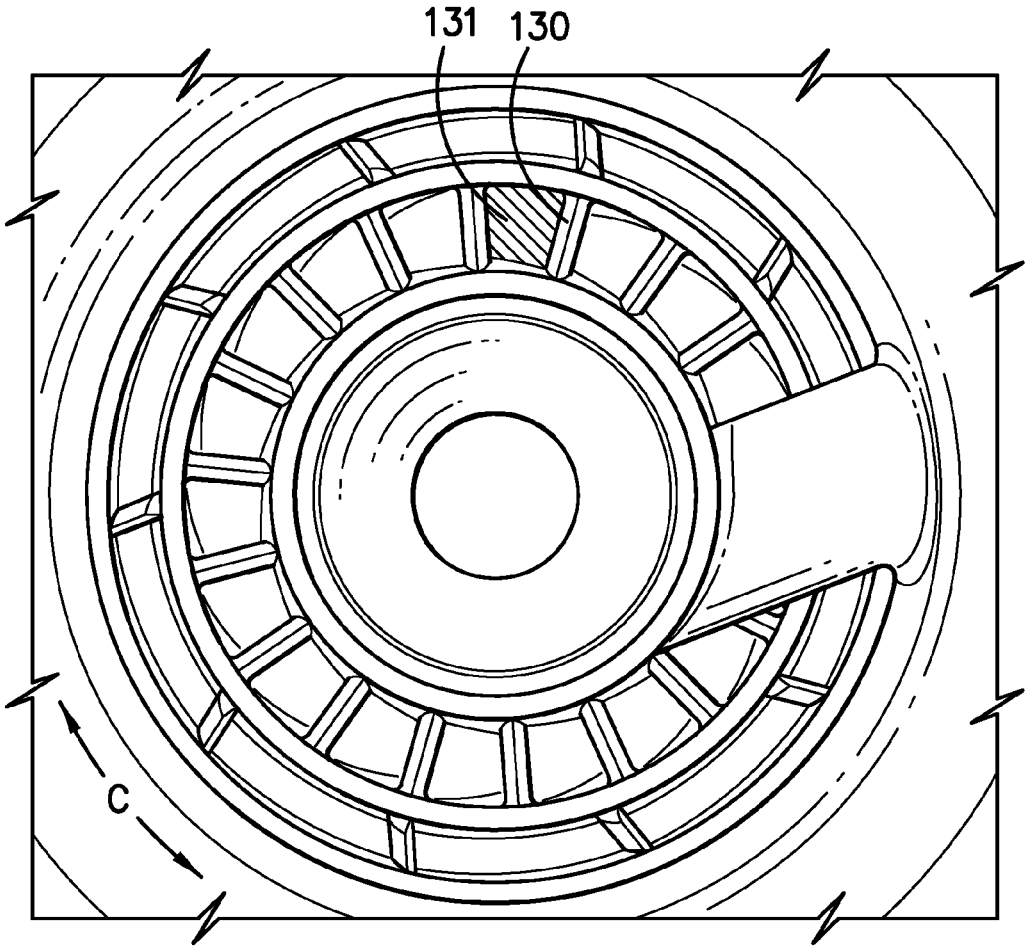
Figure 7:
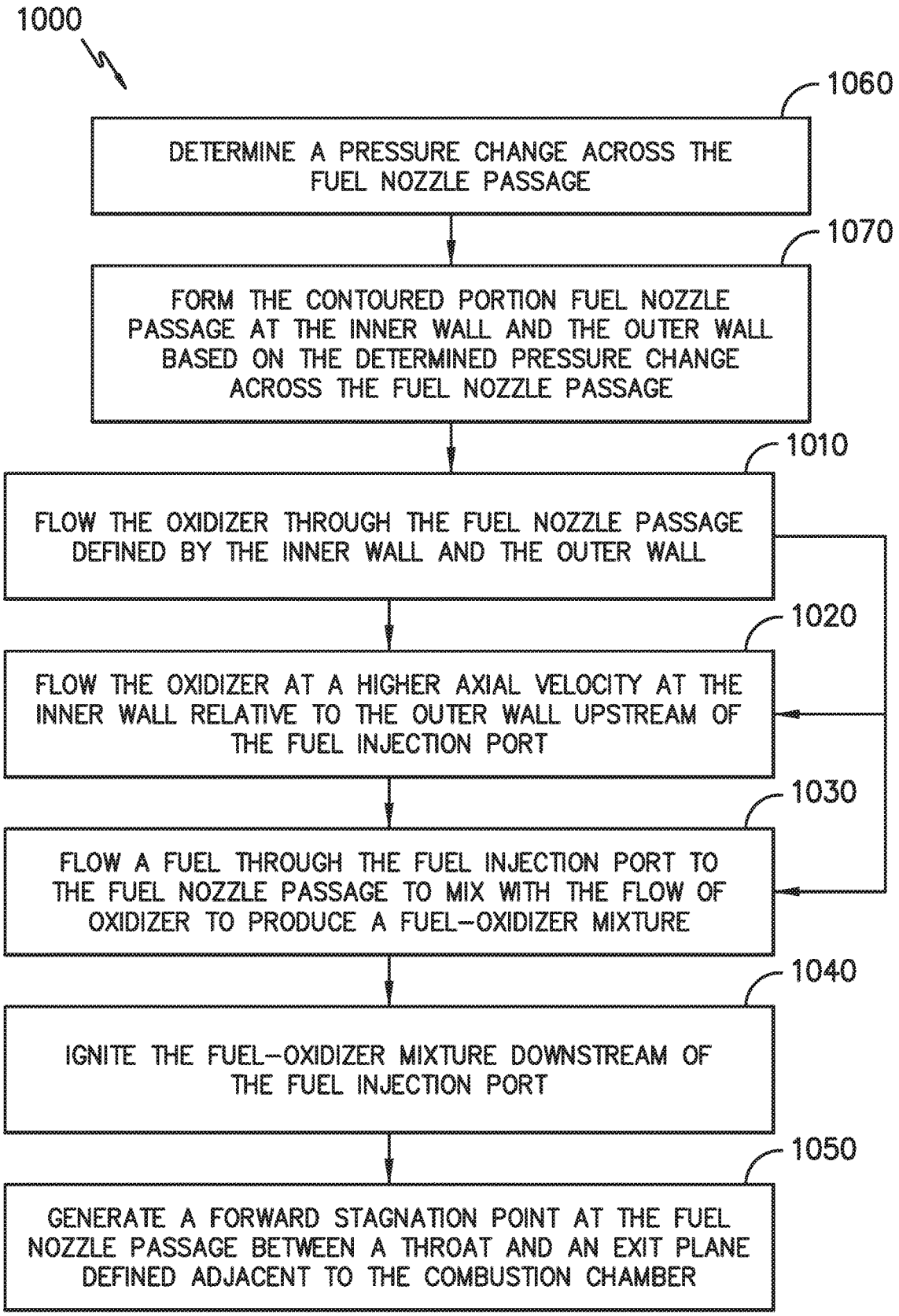
FIG. 7 is a flowchart outlining steps of an exemplary method of operating a combustion system of a gas turbine engine to mitigate low frequency combustion acoustics.

Referring now to FIG. 7, a flowchart outlining exemplary steps of a method of operating a combustion system of a gas turbine engine to mitigate low frequency combustion acoustics (hereinafter, "method 1000"), is generally provided. The method 1000 may be implemented in regard to the engine 10 and fuel nozzle 100 generally shown and provided in FIGS. 1-6. However, it should be appreciated that the method 1000 may be utilized and executed in fuel nozzles generally defining a pilot fuel circuit and fuel-oxidizer mixing passage. Still further, although the method 1000 is generally provided in a certain sequence, it should be appreciated that the steps of the method 1000 may be re-ordered, re-arranged, re-sequenced, added, or removed without removing from the scope of the present disclosure.

Referring collectively to FIGS. 1-7, the method 1000 includes at 1010 flowing the oxidizer 83 through the fuel nozzle passage 123 defined by the inner wall 120 and the outer wall 110, such as shown and described in regard to FIGS. 1-2.

The method 1000 further includes at 1020 flowing the oxidizer 83 at a higher axial velocity at the inner wall 120 relative to the outer wall 110 upstream of the fuel injection port 127, such as generally shown and described in regard to FIGS. 3-6. In various embodiments, flowing the oxidizer 83 at the higher axial velocity at the inner wall 120 defines an approximately maximum axial velocity of the flow of oxidizer 83. In one embodiment, the maximum axial velocity of the oxidizer 83 at the inner wall 120 is approximately two times an axial velocity of the oxidizer 83 at the outer wall 110. In still another embodiment, the higher axial velocity at the inner wall 120 relative to the outer wall 110 is upstream of the fuel injection port 127 and downstream of a plurality of vanes 130, such as a plurality of swirl vanes such as further described below. Still further, the higher axial velocity at the inner wall 120 relative to the outer wall 110 is downstream of a second cross sectional area 132 proximate to a trailing edge 134 of the plurality of vanes 130, such as described in regard to FIGS. 3-6.

More specifically, flowing the oxidizer 83 at the higher axial velocity at the inner wall 120 is defined upstream of the fuel injection port 127 by approximately eight diameter-lengths of the fuel injection port 127. For example, the diameter-length is defined based at least on a diameter of a jet or opening of the fuel injection port 127 through the inner wall 110. The diameter-length is the value of the diameter of the jet or opening of the fuel injection portion 127 through the inner wall 110 as a unit of measurement of the distance along the inner wall 120 of the fuel nozzle passage 123 generally along the axial direction A equal to the major axis or diameter 128 of the fuel injection port 127. As such, in one embodiment, flowing the oxidizer 83 at the higher axial velocity at the inner wall 120 is defined within a region 126 of the fuel nozzle passage 123 from the inner wall 120 to the outer wall 110 generally corresponding to a portion of the fuel nozzle passage 123 corresponding to a distance along the fuel nozzle passage 123 upstream from the fuel injection port 127 to approximately eight times the major axis or diameter 128 of the fuel injection port 127. Still more specifically, the region 126 of the fuel nozzle passage 123, in which flows the oxidizer 83 at the higher axial velocity at the inner wall 120, extends over a distance along the fuel nozzle passage 123, in which the distance is in a range from the fuel injection port 127 to approximately eight diameter-lengths upstream of the fuel injection port 127 along the inner wall 120, and the region 126 extends over a second distance approximately normal to the inner wall 110 and ranging from the inner wall 120 to a corresponding portion at the outer wall 110. In another embodiment of the fuel nozzle 100 and method 1000, the region 126 is defined within approximately four diameter-lengths from the fuel injection port 127 defined through the inner wall 120.

In still various embodiments of the step at 1020, flowing the oxidizer 83 may further define flowing the oxidizer 83 at a lower tangential velocity approximately at the inner wall 120 relative to the outer wall 110 upstream of the fuel injection port 127. For example, flowing the oxidizer 83 at the lower tangential velocity (i.e., lower velocity along a circumferential direction relative to the nozzle centerline 13) at the inner wall 120 versus the outer wall 110 includes flowing the oxidizer 83 at the lower tangential velocity within the region 126 of the fuel nozzle passage 123 such as previously described.

In yet another embodiment, flowing the oxidizer 83 through the fuel nozzle passage 123 may further include flowing the oxidizer 83 at an axial velocity (i.e., velocity generally along the axial direction A) corresponding to approximately 40% or less of a total flow rate of oxidizer 64 from the compressors 22, 24 of the engine 10 (FIG. 1). For example, the flow of oxidizer 83 through the fuel nozzle passage 123 such as to define the desired higher axial velocity, the lower tangential velocity, or both, such as described in regard to steps at 1010 and 1020, may be approximately 4% to approximately 25% or less of the total flow of oxidizer 64 entering the combustion chamber 116 of the combustion system 26.

The various embodiments of the fuel nozzle 100 and steps 1010 and 1020 of the method 1000 described herein may define the fuel nozzle passage 123, or more specifically, the contoured portion 125 of the fuel nozzle passage 123 to reduce from the first radius 101 to the second radius 102 such as to provide the higher axial velocity of the flow of oxidizer 83 within the region 126 such as described herein. The contoured portion 125 of the fuel nozzle passage 123 may further be defined to more specifically provide the higher axial velocity of the flow of oxidizer 83 at the inner wall 120 in contrast to the outer wall 110. In still various embodiments, the contoured portion 125 of the fuel nozzle passage 123 may further be defined to provide the higher axial velocity of the flow of oxidizer 83 at the inner wall 120 within the region 126 defined therein, in which the higher axial velocity defines a maximum axial velocity of approximately two times at the inner wall 120 in contrast to the outer wall 110.

In still various embodiments of the fuel nozzle 100 and steps 1010 and 1020 of the method 1000 described herein, the fuel nozzle passage 123, or more specifically, the contoured portion 125 thereof, defines the lower tangential velocity of the flow of oxidizer at the inner wall 120 in contrast to the outer wall 110. In one embodiment, the lower tangential velocity of the flow of oxidizer at the inner wall 120 is approximately one half of the tangential velocity of the flow of oxidizer at the outer wall 110. Still further, the lower tangential velocity of the flow of oxidizer 83 may be defined within the region 126 described herein.

The method 1000 further includes at 1030 flowing a fuel through the fuel injection port 127 to the fuel nozzle passage 123 to mix with the flow of oxidizer 83 to produce a fuel-oxidizer mixture 85. For example, flowing the fuel through the fuel injection port 127 includes flowing the fuel through the inner wall 120 into the fuel nozzle passage 123. In various embodiments, flowing the fuel further includes flowing the fuel through the second fuel injection port 129 to the combustion chamber 116. The method 1000 further includes igniting the fuel-oxidizer mixture downstream (e.g., toward downstream end 98) of the fuel injection port 127. Still further, in various embodiments, flowing the fuel through the fuel injection port 127, 129 provides an approximately conical spray of fuel generally along the axial direction A of flow of oxidizer 83. Still even further, flowing the fuel through the fuel injection port 127, 129 may further include flowing fuel through a dual orifice atomizer or a pressure swirl atomizer defined within the inner wall 120.

At 1050, the method 1000 may further includes generating a forward stagnation point at the fuel nozzle passage 123 between a throat 111 defined at the outer wall 110 and an exit plane 114 defined at a downstream end 112 of the outer wall 110 adjacent to the combustion chamber 116. Generating the forward stagnation point is generally based at least on flowing the oxidizer 83 at the higher axial velocity, such as described in regard to steps 1010, 1020, and providing the fuel at 1030, and igniting the fuel-oxidizer mixture 85 at step 1040.

In various embodiments, the throat 111 defined by the outer wall 110 defines a minimum cross sectional area along the fuel nozzle passage 123. The throat 111 is defined generally downstream of the fuel injection port 127. In various embodiments, the throat 111 may further be defined downstream of the second fuel injection port 129. In still various embodiments, the throat 111 may be defined downstream of each fuel injection port 127, 129. The forward stagnation point is defined generally between a reference plane 113 defined at the throat 111 extended along the radial direction R2 from the nozzle centerline 13 and the exit plane 114 defined at the downstream end 112 of the outer wall 110 extended along the radial direction R2 from the nozzle centerline 13.

The forward stagnation point defined between the reference plane 113 at the throat 111 and the exit plane 114 generally defines one or more points along the fuel nozzle passage 123 at which a local velocity of the flow of fluid (e.g., fuel-oxidizer mixture 85) is approximately zero proximate to the nozzle centerline 13. A recirculation zone of fuel-oxidizer mixture 85 may generally be defined at the forward stagnation point, such as to improve low frequency dynamics by defining the forward stagnation point between the throat 111 and the exit plane 114.

The method 1000 may further include at 1060, determining a pressure change across the fuel nozzle passage 123. Still further, the method 1000 may further include at 1070 forming the contoured portion 125 fuel nozzle passage 123 at the inner wall 120 and the outer wall 110 based on the determined pressure change across the fuel nozzle passage 123. Determining the pressure change across the fuel nozzle passage 123 may generally define an overall size of the fuel nozzle 100. The overall size of the fuel nozzle 100 may generally limit an overall maximum axial velocity and/or tangential velocity of the flow of oxidizer 83 through the fuel nozzle passage 123. As such, structure, such as defined in regard to the fuel nozzle 100, and methods 1000 of defining the structure of the fuel nozzle 100, enable mitigating or eliminating combustion dynamics, such as low frequency growl (e.g., frequencies between approximately 60 Hz and approximately 200 Hz), due to combustion of the fuel-oxidizer mixture 85. The embodiments of the fuel nozzle 100 and methods 1000 generally provided herein distribute the maximum axial velocity, the minimum tangential velocity, or both, such as to mitigate or eliminate undesired combustion dynamics that may otherwise damage or impair operation of the combustor assembly 95 and the engine 10.

Figure 4:
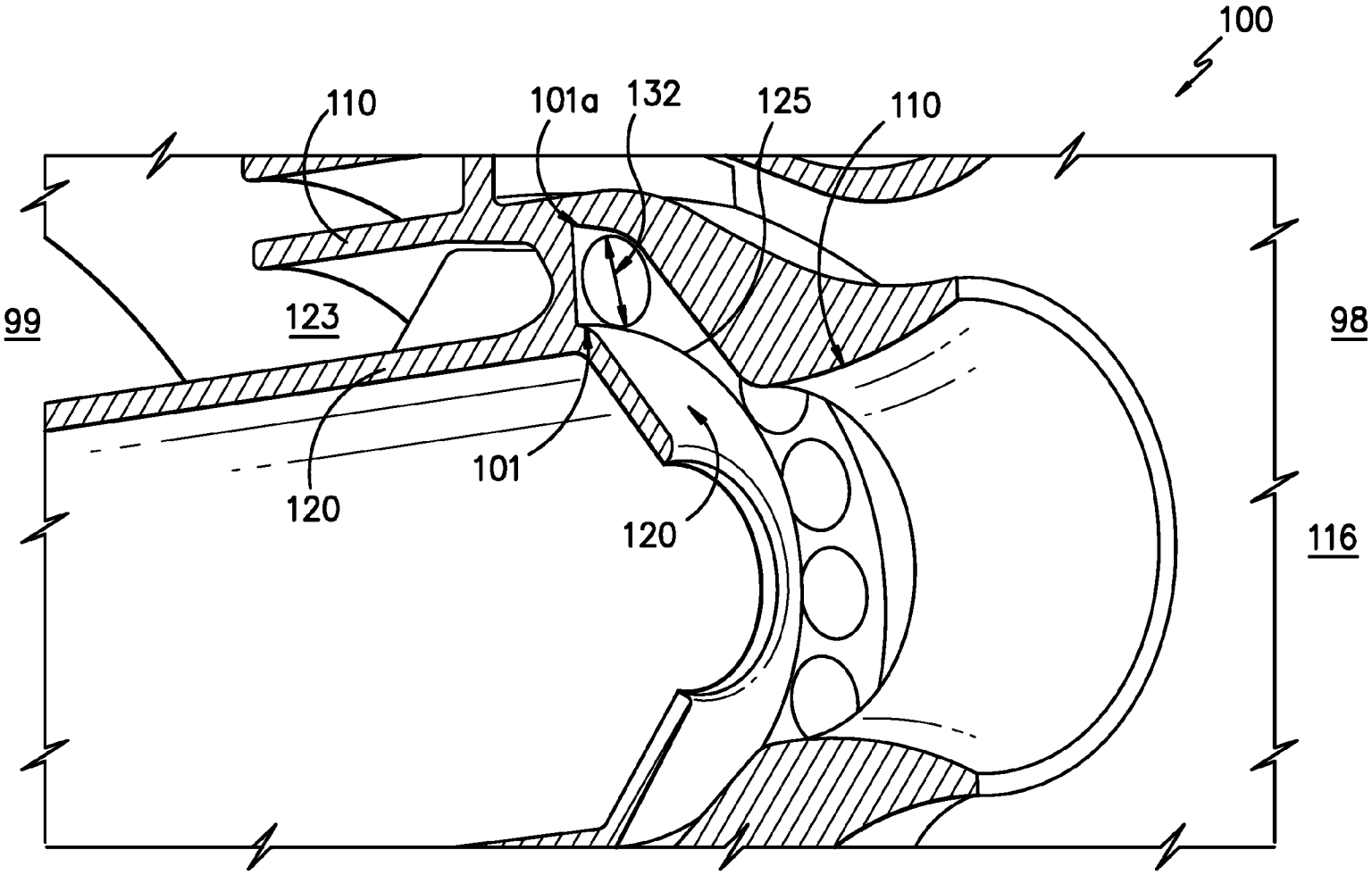
FIGS. 4-6 are perspective views of exemplary embodiments of portions of the fuel nozzle generally provided in FIG. 3.
Figure 5:
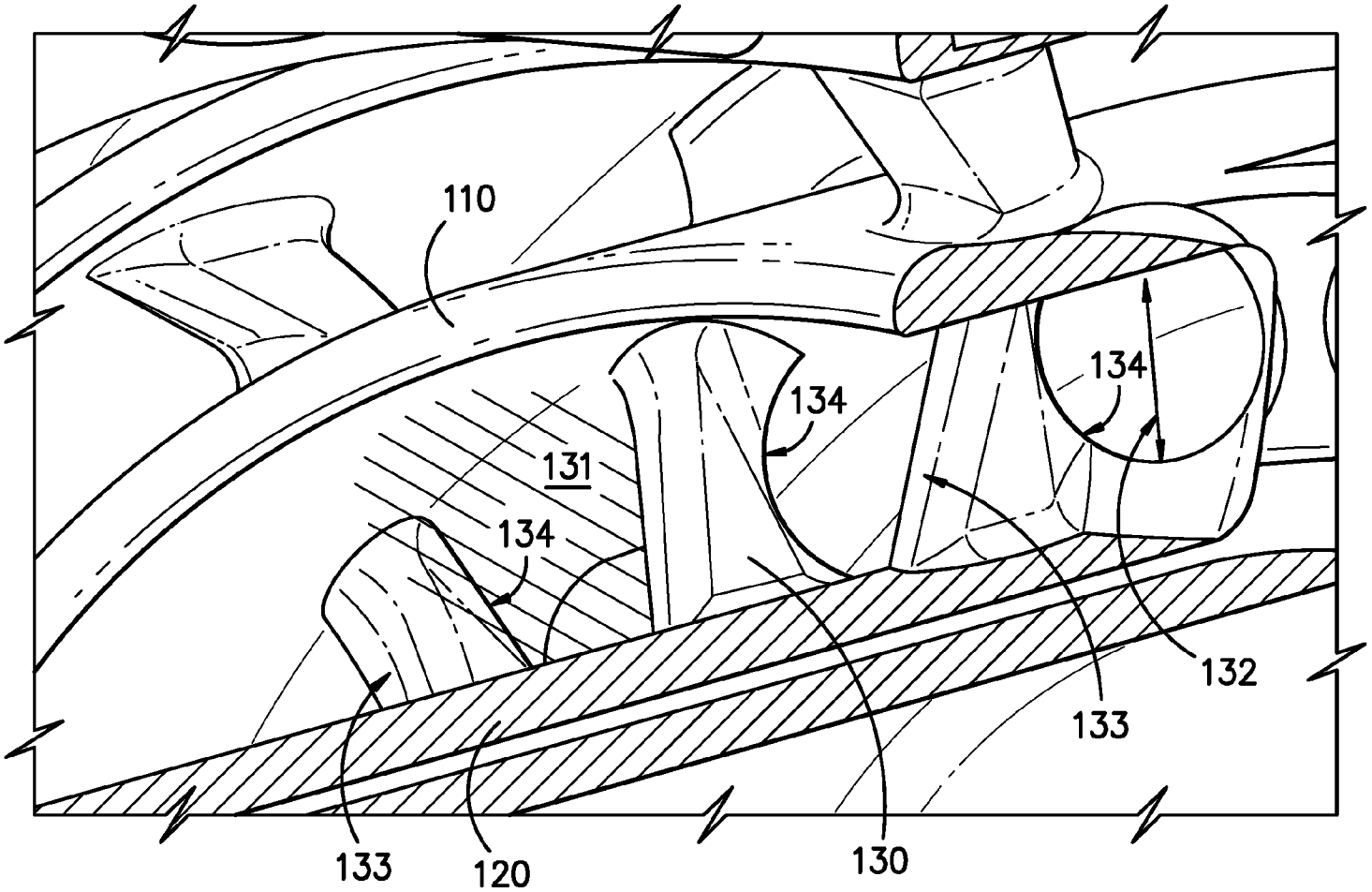

Referring now to FIGS. 4-6, perspective views of portions of the fuel nozzle 100 generally shown in FIG. 3 are generally provided. Referring to FIGS. 3-6, the fuel nozzle 100 may further include a plurality of vanes 130 in adjacent circumferential arrangement around the nozzle centerline 13. Each vane 130 is extended between the inner wall 120 and the outer wall 110 upstream (i.e., toward the upstream end 99) of the fuel injection port 127. Each adjacent pair of vanes 130 defines a first cross sectional area 131 circumferentially therebetween proximate to a leading edge 133 (i.e., portion of the vane 130 proximate to the upstream end 99) and a second cross sectional area 132 proximate to a trailing edge 134 (i.e., portion of the vane 130 proximate to the downstream end 98). The second cross sectional area 132 is different from the first cross sectional area 131.

In various embodiments, the plurality of vanes 130 is extended at least partially along the circumferential direction or the tangential direction relative to the nozzle centerline 13. For example, the leading edge 133 or first cross sectional area 131 is disposed offset along the circumferential direction, or tangential direction, relative to the trailing edge 134 or second cross sectional area 132. In one embodiment, such as generally shown in FIG. 6, the offset generated by at least partially extending the vanes 130 along the circumferential direction C, or a tangential direction, or both, from the leading edge 133 to the trailing edge 134 prevents "see through" along the axial direction A. For example, referring to FIG. 6 viewed from the upstream end 99 toward the downstream end 98, the plurality of vanes 130 extends the trailing edge 134 to a circumferential location relative to the nozzle centerline 13 different from the leading edge 133 such as to at least partially obscure the second cross sectional area 134 from view along a downstream direction relative to the first cross sectional area 132. As one example, the vanes 130 may obscure the second cross sectional area 134 from view along a downstream direction relative to the first cross sectional area 132 by at least approximately 50%. As another example, the vanes 130 may obscure the second cross sectional area 132 from view along a downstream direction relative to the first cross sectional area 131 by at least approximately 90%. As yet another example, referring still to FIG. 6 viewed from the upstream end 99 toward the downstream end 98, the second cross sectional area 132 may be generally or approximately fully obscured by the vanes 130 extended along the tangential or circumferential direction C relative to the nozzle centerline 13 from the leading edge 133 to the trailing edge 134 of each vane 130.

Referring still to FIGS. 3-6, the contoured portion 125 defining the first radius 101 is defined approximately at the second cross sectional area 132. The contoured portion 125 defining the second radius 102 is defined approximately at the fuel injection port 127 through the inner wall 120.

Various embodiments of the first cross sectional area 131 and the second cross sectional area 132 may include one or more combinations of a rectangular cross section, a circular cross section, an elliptical, ovular, or oblong cross sectional area, or a polygonal cross sectional area. The first cross sectional area 131 and the second cross sectional area 132 may further define larger or smaller cross sectional areas relative to one another. In still various embodiments, the plurality of vanes 130 may generally define the pressure change or pressure loss determined at step 1060. The pressure change at the second cross sectional area 132 may further define the contoured portion 125 of the fuel nozzle passage 123 such as to distribute the higher axial velocity of the flow of oxidizer 83 at the inner wall 120 rather than outer wall 110. The pressure change at the second cross sectional area 132 may still further define the contoured portion 125 such as to distribute the lower tangential velocity of the flow of oxidizer 83 at the inner wall 120 rather than the outer wall 110.

As described herein, the axial velocity and the tangential velocity of the flow of oxidizer 83 may generally define a gradient between the inner wall 120 and the outer wall 110. For example, the gradient may be defined from the inner wall 120 generally normal to the opposing outer wall 110 (or, alternatively, from the outer wall 110 to the opposing inner wall 120). The gradient may define the axial velocity of the flow of oxidizer 83 defining the maximum axial velocity of the flow of oxidizer 83 approximately at the inner wall 120. The gradient may further define the axial velocity of the flow of oxidizer 83 defining a lesser axial velocity of the flow of oxidizer generally closer or more proximate to the outer wall 110.

The gradient may further define the tangential velocity of the flow of oxidizer 83 defining the minimum or lowest tangential velocity of the flow of oxidizer approximately at the inner wall 120. The gradient may further define the tangential velocity of the flow of oxidizer 83 defining a generally greater tangential velocity of the flow of oxidizer generally closer or more proximate to the outer wall 110.

It should be appreciated that the gradient of the velocity of the flow of oxidizer 83 between the inner wall 120 and the outer wall 110 may be defined non-linearly therebetween. Still further, it should be appreciated that the maximum axial velocity at the inner wall 120 or the minimum or lowest tangential velocity at the inner wall 120, or other definitions of the velocity relative to the inner wall 120 or the outer wall 110, may be understood as being defined from the respective wall (e.g., inner wall 120, outer wall 110) and along a normal direction into the fuel nozzle passage 123 for a distance of approximately 10% or less of the overall distance between the inner wall 120 and the outer wall 110. For example, referring to FIG. 3, the region 126 of the fuel nozzle passage 123 may be defined from a portion 136 of the inner wall 120 normal toward the outer wall 110 defining up to approximately 10% of an area between the outer wall 110 and the inner wall 120. As another example, the region 126 of the fuel nozzle passage 123 may be defined from a portion 137 of the outer wall 110 normal toward the inner wall 120 defining up to approximately 10% of an area between the inner wall 120 and the outer wall 110.

In various embodiments of the fuel nozzle 100 and methods 1000 generally provided, low frequency acoustics or low growl may be mitigated at one or more flow rates or flow conditions of the flow of oxidizer 83 through the fuel nozzle passage 123. For example, in one embodiment, low frequency acoustics or low growl may be mitigated at conditions in which approximately 4% to approximately 25% or less of a total flow of oxidizer 64 entering the combustion chamber 116 enters a pilot portion of the fuel nozzle 100 through the fuel nozzle passage 123.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a combustion system of a gas turbine engine to mitigate low frequency combustion acoustics, the method comprising:

flowing an oxidizer through a fuel nozzle passage defining an inner wall and an outer wall, wherein each of the inner wall and the outer wall are contoured from a first respective radius to a second respective radius smaller than the first respective radius;

at a region upstream of a fuel injection port, flowing the oxidizer at a higher axial velocity at the inner wall relative to an axial velocity at the outer wall;

flowing a fuel through the fuel injection port to the fuel nozzle passage to mix with the oxidizer to produce a fuel-oxidizer mixture;

igniting the fuel-oxidizer mixture downstream of the fuel injection port; and generating a forward stagnation point based at least on flowing the oxidizer at the higher axial velocity at the inner wall, wherein the forward stagnation point is within the fuel nozzle passage at a location that is downstream of a downstream axial end of the inner wall, downstream of a throat defined by the outer wall, and upstream of an exit end of the outer wall.

2. The method of claim 1, wherein the forward stagnation point is upstream of an exit plane defined at the exit end of the outer wall adjacent to a combustion chamber.

3. The method of claim 1, further comprising: determining a pressure change across the fuel nozzle passage.

4. The method of claim 1, wherein flowing the fuel through the fuel injection port includes flowing the fuel through the fuel injection port defined through the inner wall.

5. The method of claim 1, wherein flowing the oxidizer at the higher axial velocity at the inner wall defines a maximum axial velocity of the oxidizer in the fuel nozzle passage.

6. The method of claim 5, wherein the maximum axial velocity of the oxidizer at the inner wall is approximately two times the axial velocity of the oxidizer at the outer wall.

7. The method of claim 1, wherein flowing the oxidizer at the higher axial velocity at the inner wall comprises flowing the oxidizer at the higher axial velocity in the region of the fuel nozzle passage is defined along the inner wall from the fuel injection port to a location that is between four to eight diameter-lengths of a diameter of the fuel injection port, upstream of the fuel injection port.

8. The method of claim 7, wherein flowing the oxidizer at the higher axial velocity at the inner wall relative to the axial velocity at the outer wall comprises flowing the oxidizer at the axial velocity in the region along the fuel nozzle passage that is defined along the outer wall from the fuel injection port to a second location that is between four and eight diameter-lengths of the diameter of the fuel injection port, upstream of the fuel injection port.

9. The method of claim 1, wherein flowing the fuel through the fuel injection port provides an conical spray of fuel along an axial direction of flow of the oxidizer.

10. The method of claim 9, wherein flowing the fuel through the fuel injection port further comprises flowing fuel through a dual orifice atomizer.

11. The method of claim 9, wherein flowing the fuel through the fuel injection port further comprises flowing fuel through a pressure swirl atomizer.

12. The method of claim 1, wherein flowing the oxidizer further defines a lower tangential velocity at the inner wall relative to a tangential velocity at the outer wall in the region upstream of the fuel injection port.

13. The method of claim 1, wherein flowing the oxidizer through the fuel nozzle passage comprises flowing the oxidizer at the axial velocity corresponding to between 4% to 25% of a total flow of the oxidizer entering a combustion chamber from one or more compressors of the gas turbine engine.

14. The method of claim 1, wherein flowing the oxidizer through the fuel nozzle passage comprises flowing the oxidizer at the axial velocity corresponding to an idle condition or lower of the gas turbine engine.

* * * * *